US010648377B2

(12) United States Patent
Karlsson et al.

(10) Patent No.: US 10,648,377 B2
(45) Date of Patent: May 12, 2020

(54) VARIABLE VALVE ACTUATION MECHANISM, AN INTERNAL COMBUSTION ENGINE, AND A VEHICLE

(71) Applicant: VOLVO TRUCK CORPORATION, Göteborg (SE)

(72) Inventors: Johan Karlsson, Landvetter (SE); David Norén, Hindås (SE); Hans Bondeson, Mölnlycke (SE)

(73) Assignee: VOLVO TRUCK CORPORATION, Göteborg (SE)

( * ) Notice: Subject to any disclaimer, the term of this patent is extended or adjusted under 35 U.S.C. 154(b) by 0 days.

(21) Appl. No.: 15/750,426

(22) PCT Filed: Aug. 19, 2015

(86) PCT No.: PCT/EP2015/069063
§ 371 (c)(1),
(2) Date: Feb. 5, 2018

(87) PCT Pub. No.: WO2017/028918
PCT Pub. Date: Feb. 23, 2017

(65) Prior Publication Data

US 2018/0223705 A1 Aug. 9, 2018

(51) Int. Cl.
*F01L 1/18* (2006.01)
*F01L 13/00* (2006.01)
(Continued)

(52) U.S. Cl.
CPC ..... *F01L 13/0047* (2013.01); *F01L 1/181* (2013.01); *F01L 1/20* (2013.01);
(Continued)

(58) Field of Classification Search
CPC ..... F01L 1/181; F01L 13/0047; F01L 2001/0473
(Continued)

(56) References Cited

U.S. PATENT DOCUMENTS 8,820,281 B2 9/2014 Dietel et al.
9,140,151 B2 * 9/2015 Matsumochi ..... F01L 1/047 123/90.16
(Continued)

FOREIGN PATENT DOCUMENTS

CN 102292523 A 12/2011
CN 103649477 A 3/2014
(Continued)

OTHER PUBLICATIONS

International Search Report (dated Apr. 7, 2016) for corresponding International App. PCT/EP2015/069063.
(Continued)

*Primary Examiner* — Ching Chang
(74) *Attorney, Agent, or Firm* — Venable LLP; Jeffri A. Kaminski

(57) ABSTRACT

A variable valve actuation mechanism is provided for an internal combustion engine including at least one valve for control of gas admission to a cylinder of the engine and/or gas exhaust from the cylinder. The mechanism includes two concentrically arranged camshafts, a cam set comprising two cams, each fixed to a respective of the camshafts, whereby the camshafts are arranged to be turned in relation to each other, so as to change the combined profile of the cams, and a cam follower adapted to follow the combined profile of the cams and to actuate at least one of the at least one valve in dependence on the combined profile of the cams, wherein the cam follower includes two rollers, each roller being adapted to follow a respective one of the cams.

24 Claims, 7 Drawing Sheets

(51) Int. Cl.
*F01L 1/047* (2006.01)
*F01L 1/20* (2006.01)

(52) U.S. Cl.
CPC ... *F01L 2001/0473* (2013.01); *F01L 2101/02* (2013.01); *F01L 2105/00* (2013.01); *F01L 2820/01* (2013.01); *F01L 2820/02* (2013.01)

(58) Field of Classification Search
USPC ..... 123/90.16, 90.39, 90.44
See application file for complete search history.

(56) References Cited

U.S. PATENT DOCUMENTS

| | | | |
|---|---|---|---|
| 2008/0190386 | A1 | 8/2008 | Raghavan et al. |
| 2009/0095241 | A1 | 4/2009 | Ihlemann |
| 2011/0265750 | A1 | 11/2011 | Becker et al. |
| 2011/0265751 | A1 | 11/2011 | Becker et al. |
| 2012/0024246 | A1 | 2/2012 | Klingbeil |
| 2012/0325168 | A1 | 12/2012 | Nitz et al. |
| 2015/0007789 | A1 | 1/2015 | Matsumochi et al. |
| 2015/0096512 | A1 | 4/2015 | Aquino |

FOREIGN PATENT DOCUMENTS

| | | | |
|---|---|---|---|
| DE | 102011115533 | A1 | 4/2013 |
| JP | S61028709 | A | 2/1986 |
| JP | H06331003 | A | 11/1994 |
| WO | 2007053070 | A1 | 5/2007 |
| WO | 2008157076 | A1 | 12/2008 |

OTHER PUBLICATIONS

Chinese Office Action in Chinese corresponding application No. 201580082461.0 dated Nov. 27, 2019 (5 pages).

* cited by examiner

VARIABLE VALVE ACTUATION MECHANISM, AN INTERNAL COMBUSTION ENGINE, AND A VEHICLE

BACKGROUND AND SUMMARY

The invention relates to a variable valve actuation mechanism for an internal combustion engine, an internal combustion engine comprising a variable valve actuation mechanism, and a vehicle comprising such an engine.

In internal combustion engines for vehicles, e.g. light vehicles such as personal cars, or heavy vehicles, such as trucks, it is known to have systems for changing the characteristics for the actuations of the intake and/or exhaust valves, e.g. the timing and/or the degree of opening of the valves.

Various techniques are known for such variable valve actuation (VVA) systems. For example, one of them is cam switching, in which adjustment mechanisms are provided in the cam followers. Cam switching concepts may include followers in the form of switchable levers, in which some parts are movable in relation to other parts.

US2012325168 relates to a switchable lever for a cam shifting system. The lever comprises two rolls, one of which is movable for coming into and out of contact with one of two cam lobes. US2011265750 and US2011265751 also relate to switchable levers for cam shifting systems, with rolls movable between positions of a high-lift cam contact and a low-lift cam contact.

Another VVA technique is known as the concentric camshaft concept. Therein, the adjustment mechanisms are provided in the camshaft arrangement, the follower parts are fixed in relation to each other. The concentric camshaft concept involves coaxial camshafts and combined cam lobe profiles. For the valve, or the valves, for the intake or exhaust function at each cylinder, one follower spans a pair of closely spaced cam lobes. Two camshafts are arranged in a concentric manner. The cam lobes are fixed to a respective of the camshafts, and can thereby, by twisting of one camshaft in relation to the other, be moved in relation to each other so as the change the combined profile of the two lobes.

Known solution with the concentric camshaft concept are disclosed in U.S. Pat. Nos. 1,527,456A, 4,771,742A and 8,820,281. US2015007789 discloses a valve gear with two camshafts and two vane rotors coupled to a respective of the camshafts.

There is a desire to reduce wear in variable valve actuation mechanisms, which are subject to harsh conditions with long durations and a very high number of cycles.

It is desirable to reduce wear in variable valve actuation mechanisms for internal combustion engines.

According to an aspect of the invention, a variable valve actuation mechanism is provided for an internal combustion engine comprising at least one valve for control of gas admission to a cylinder of the engine and/or gas exhaust from the cylinder, comprising two concentrically arranged camshafts, a cam set comprising two cams, each fixed to a respective of the camshafts, whereby the camshafts are arranged to be turned in relation to each other, so as to change the combined profile of the cams, and a cam follower adapted to follow the combined profile of the cams and to actuate at least one of the at least one valve in dependence on the combined profile of the cams, wherein the cam follower comprises two rollers, each roller being adapted to follow a respective of the cams.

It is understood that, the cam follower is adapted to be in contact with the cams, and to thereby follow the combined profile of the cams so as to actuate at least one of the valves in dependence on the combined profile of the cams. The rollers are adapted to provide the contact of the cam follower with the cams. The cams may be are arranged to be moved in relation to each other by turning of one of the camshafts in relation to the other, so as to change the combined profile of the cams.

Since the cam follower comprises two rollers, each roller being adapted to follow a respective of the cams, the risk of contact of a roller with an edge of any of the cams is greatly reduced. This in turn provides for significantly reducing wear in the variable valve actuation mechanism. More specifically, with the double roller solution, it is possible to avoid a situation where a roller surface bridges the two cams, and is thereby exposed to potential contact with the cam edges. Further, as also exemplified below with reference to FIG. 7, the double roller solution provides for avoiding skidding of a roller surface against a cam surface. Without the two roller solution, such skidding may occur, e.g. when the cam follower transits from one of the cams to the other one, and due to local differences in the inclination or declination of the cams, the rotational speeds to which the cams urges a single roller will be different. Two rollers will solve this problem by allowing individual adaption of the rotational speed to the respective cam. Thus, the invention provides for reducing wear caused by skidding as well as edge contact.

Preferably, at least one of the rollers presents a contact surface having a crowning profile. As also explained below, this increases tolerances to misalignment in a manufacturing process as well as misalignment due to operating loads, and further reduces the risk of edge contact between a roller and a cam. The crowning may provide, in the axial direction of the roller, a variation of 0.005-0.050 mm, preferably 0.010-0.030 mm, of the radial position of the contact surface.

At least one of the rollers may present a contact surface having a crowning profile with a crowning shape of a logarithmic function, or a function in the form of $Y(X)=AX^B$ where A and B are real numbers and B is greater than 2. At least one of the rollers may present a contact surface having a crowning profile providing a part-circular outer surface for contacting its associated cam.

Preferably, at least one of the rollers presents a contact surface having a smaller extension in an axial direction than its associated cam. Thereby, it can be made sure that an angular misalignment between the rollers and the cams does not lead to any contact between a cam edge and a roller. If in addition the rollers are crowned, contacts between the cams and the rollers, without any edge contact, will be secured.

Preferably, the axial freedom of movement of the roller is shorter than the difference between the axial extensions of the contact surface of the roller and its associated cam. Thereby, possible axial movements of the roller may be kept within the axial extension of the cam, which in turn eliminates any risk of contact of the roller with one of the cam edges. This in turn reduces the risk of excessive wear. The allowed axial movement of each rollers might be 1.0-10.0%, preferably 1.7-5.0%, of the axial extension (width) of the roller. In some embodiments, each roller is fixed in the axial direction of the roller, in relation to the respective cam which the respective roller is adapted to follow.

Preferably, the rollers are fixed concentrically in relation to each other. Preferably, the cam follower comprises two support arms and wherein the rollers are both mounted between the two support arms. Preferably, the cam follower comprises a shaft, which is supported at each end in one of the two support arms and wherein the rollers are concentrically arranged on the shaft. Preferably, the cam follower comprises a shaft, the rollers being concentrically arranged on the shaft via respective sliding bearings. Preferably, the shaft is provided with a friction reducing layer, for example a PVD (physical vapour deposition) coating. The shaft is advantageously made of steel; alternatively the shaft might be made in any suitable alternative material, such as a bronze alloy. The rollers might be made of steel, but any suitable material alternative is possible.

Preferably, each roller presents a heel at each end of its axial extension. Each heel might be provided as an axial protrusion presenting a flat surface oriented in a plane with a normal which is parallel to the axial direction of the respective roller.

Preferably, the rollers are adapted to turn independently of one another. Preferably, the rollers have substantially the same extension in an axial direction and/or radial direction. The rollers may have different extensions in the axial direction; this may provide benefits where the loadings on the rollers are different, and there is a lack of space around the rollers.

According to another aspect of the present invention, a variable valve actuation mechanism is provided for an internal combustion engine comprising at least one valve for control of gas admission to a cylinder of the engine and/or gas exhaust from the cylinder, comprising two concentrically arranged camshafts, a cam set comprising two cams, each fixed to a respective of the camshafts, whereby the camshafts are arranged to be turned in relation to each other, so as to change the combined profile of the cams, and a cam follower adapted to follow the combined profile of the cams and to actuate at least one of the at least one valve in dependence on the combined profile of the cams, wherein the cam follower comprises a roller presenting, in a cross-section coinciding with a rotational axis of the roller, two protuberances being adapted to follow a respective of the cams, the protuberances being separated by a concavity.

According to another aspect of the invention, an internal combustion engine is provided comprising a variable valve actuation mechanism according to any of the embodiments described or claimed herein, and by a vehicle comprising such an engine.

BRIEF DESCRIPTION OF DRAWINGS

Below, embodiments of the invention will be described with reference to the drawings, in which.

DETAILED DESCRIPTION

Figure 1:
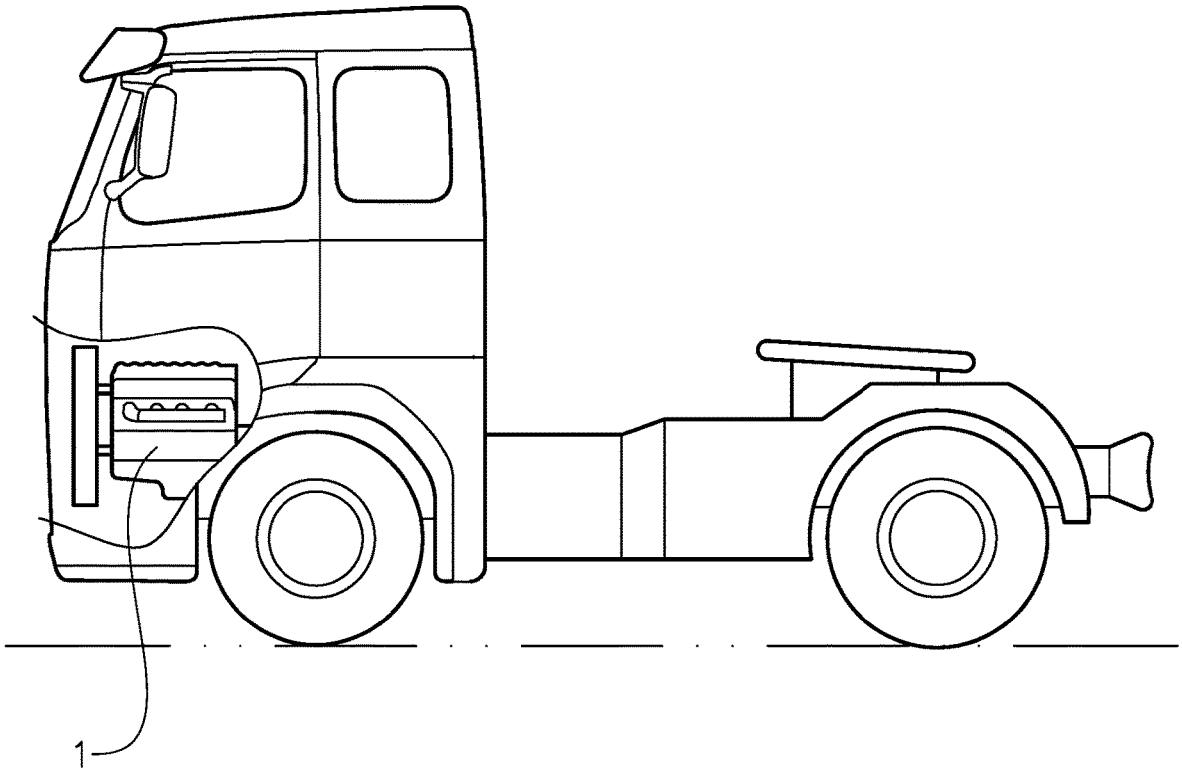
FIG. 1 shows a partially sectioned side view of a vehicle.

FIG. 1 shows a vehicle in the form of a truck comprising an internal combustion engine 1, in this example a diesel engine. The engine comprises a plurality of cylinders, and a plurality of intake valves for control of gas admission to the cylinders and a plurality of exhaust valves for control of gas exhaust from the cylinders. The engine also comprises variable valve actuation mechanism for actuation of the intake valves, and a further variable valve actuation mechanism for actuation of the exhaust valves.

Figure 2:
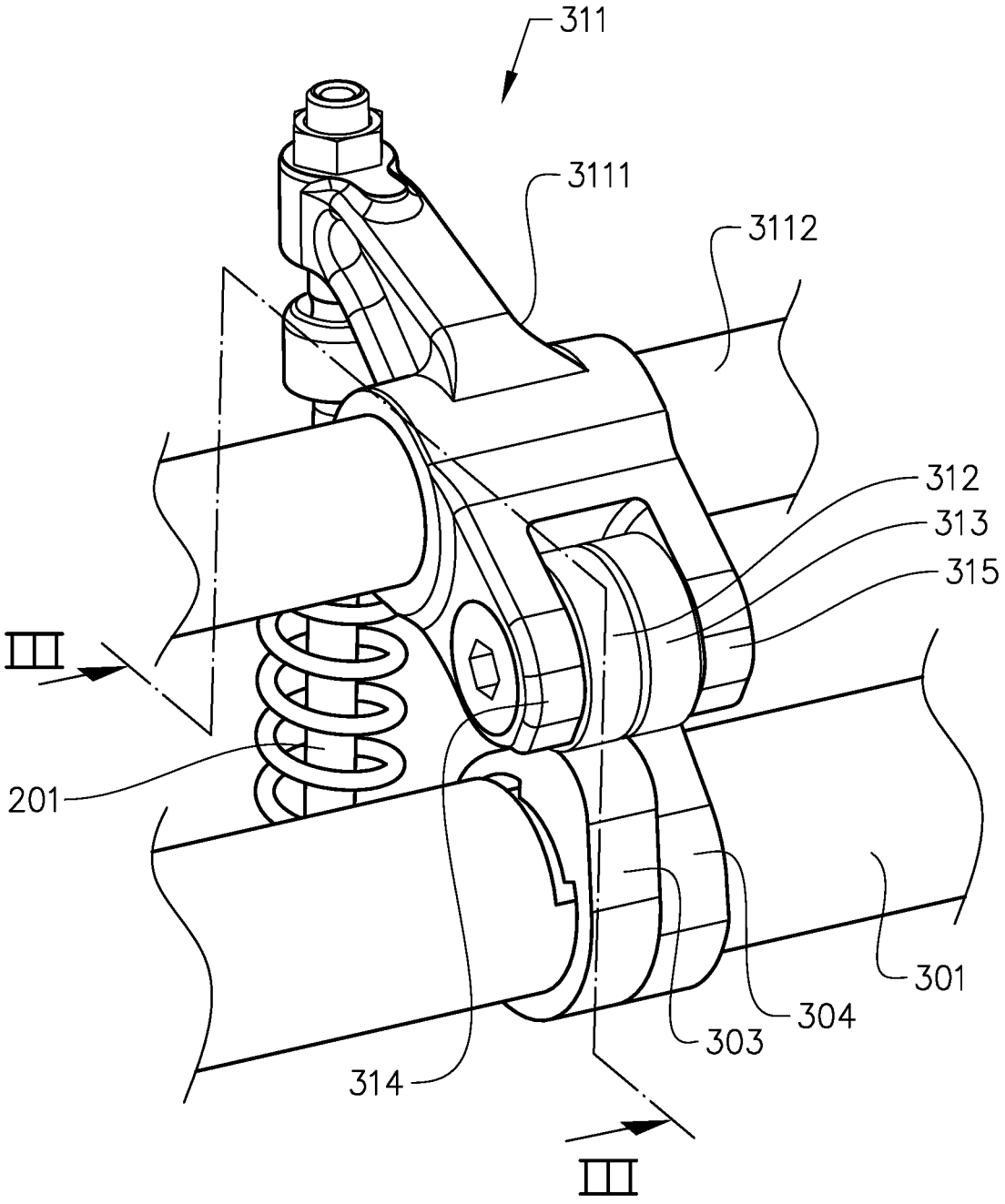
FIG. 2 shows a perspective view of a portion of a variable valve actuation mechanism of an engine in the vehicle in FIG. 1.

FIG. 2 shows a portion of the variable valve actuation mechanism for actuation of the intake valves 2. The portion shown is adapted to actuate one of the intake valves 201 at one of the cylinders.

Figure 3:
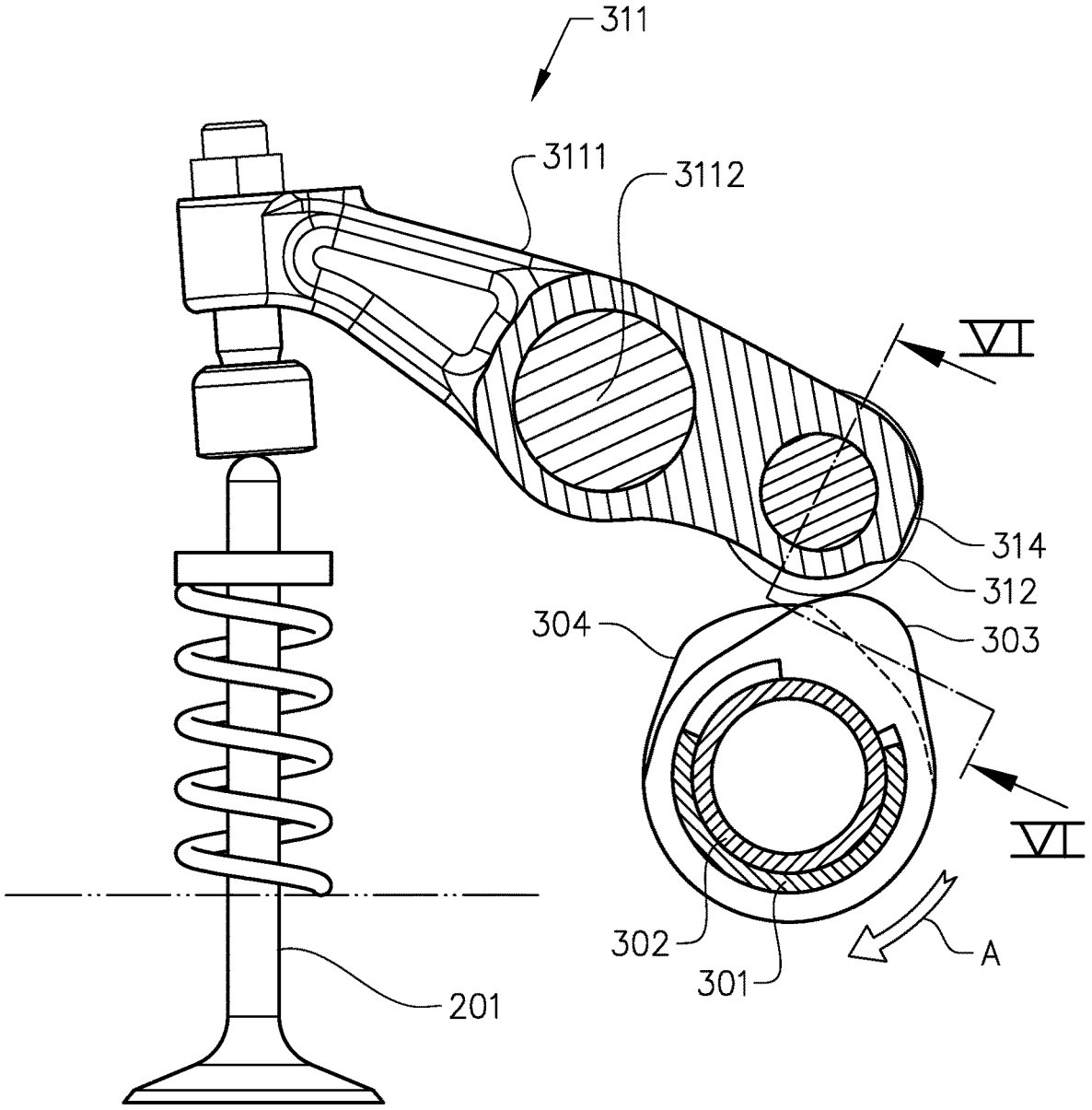
FIG. 3 shows a cross-sectional view with the section oriented as indicated with the arrows III-III in FIG. 2.

Reference is made also to FIG. 3. The valve actuation mechanism comprises two concentrically arranged camshafts 301, 302. For the intake valve 201, a cam set comprising two cams 303, 304 is provided. The cams 303, 304 are distributed in the longitudinal direction of the camshafts. The cams 303, 304 in each cam set are adjacent or in the immediate vicinity to each other.

Each cam 303, 304 is fixed to a respective of the camshafts 301, 302. The camshafts 301, 302 are arranged to be turned in relation to each other, so as to change the combined profile of the cams 303, 304. More specifically, the cams 303, 304 are arranged to be moved in relation to each other by turning of one of the camshafts 301, 302 in relation to the other, so as to change the combined profile of the cams 303, 304.

The arrow A in FIG. 3 indicates the rotational direction of the camshafts in this example. A first 303 of the cams has a higher profile, i.e. a larger radial extension, than a second 304 of the cams. Further, the first cam 303 is arranged to be ahead of the second cam 304 in the rotation direction A. Thereby, the cams 303, 304 may be arranged, as described further below, so as to provide a relatively high initial lift of the valve 201, governed by the first cam 303, followed by a second phase where the cam lift can be extended with a lower lift governed by the second cam 304, before a closure of the valve 201. It should be noted that the particular characteristics of the valve lift are not critical to the implementation of the invention. For example, alternatively, the lift governed by the second cam 304 may be as high as the lift governed by the first cam 303.

The valve actuation mechanism further comprises a cam follower 311 adapted to follow the combined profile of the cams 303, 304 and to actuate the intake valve 201 in dependence on the combined profile of the cams 303, 304. The cam follower comprises a rocker arm 3111 adapted to pivot around a rocker arm shaft 3112. On one side of the rocker arm shaft 3112, the rocker arm 3111 presents a first end at which two rollers 312, 313 are mounted, each roller 312, 313 being adapted to follow a respective of the cams 303, 304. On the opposite side of the rocker arm shaft 3112, the rocker arm 3111 presents a second end at which the rocker arm 3111 is adapted to be in contact with the valve 201 for actuation of the latter.

It should be noted that in other embodiments, the rocker arm 3111 may be adapted to actuate two or more than two intake valves at the cylinder. For this, there may be a yoke or a valve bridge provided to distribute the action of the rocker arm to the valves.

Figure 4:
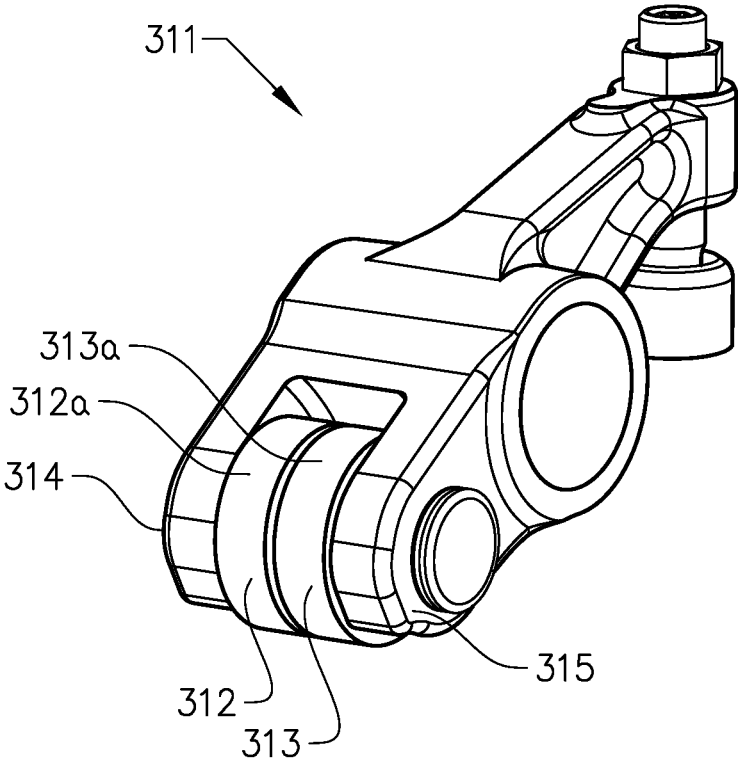
FIG. 4 shows a perspective view of a part of the variable valve actuation mechanism.
Figure 5:
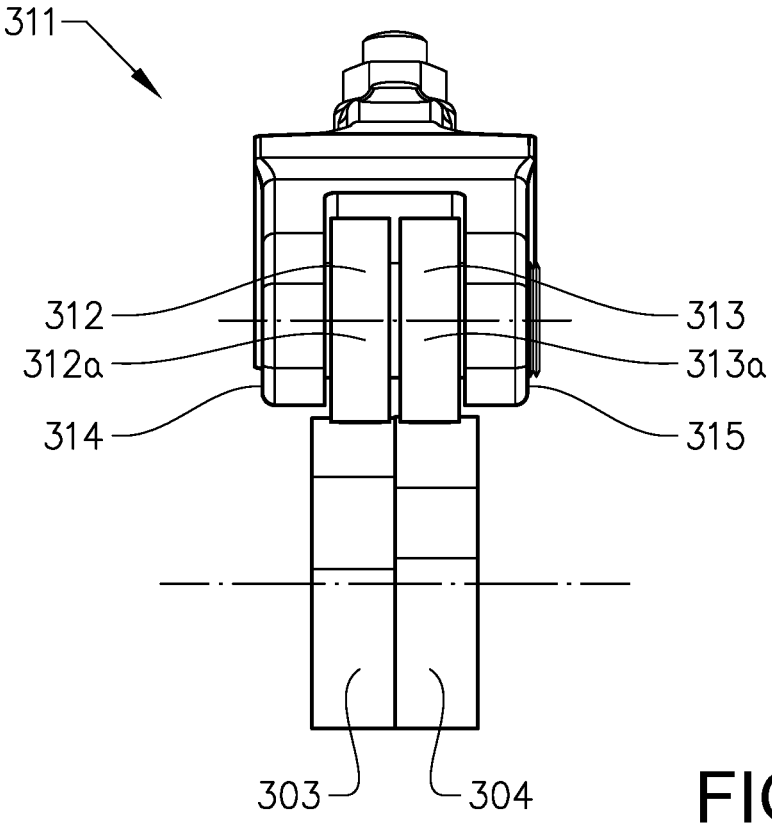
FIG. 5 shows a front view of parts of the variable valve actuation mechanism.
Figure 6:
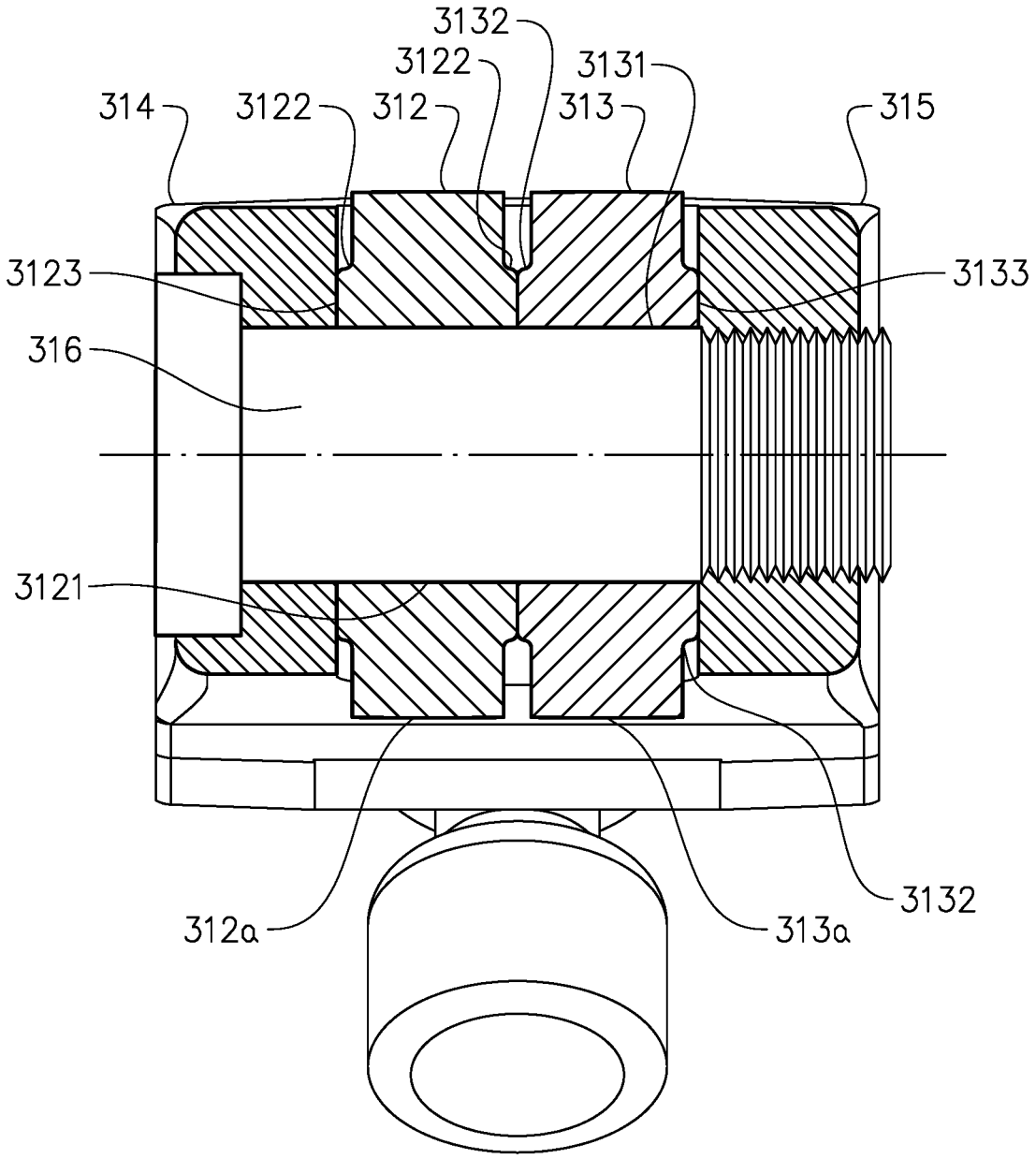
FIG. 6 shows a cross-sectional view with the section oriented as indicated with the arrows VI-VI in FIG. 3.

Reference is made also to FIG. 4, FIG. 5 and FIG. 6. Each roller 312, 313 is permanently aligned axially with a respective of the cams 303, 304. The cam follower 311 comprises two support arms 314, 315 and the rollers 312, 313 are both mounted between the two support arms 314, 315.

As can be seen in FIG. 6, the cam follower comprises a shaft 316, which is supported at each end in one of the two support arms 314, 315. The rollers 312, 313 are concentrically arranged on the shaft 316 via respective sliding bearings 3121, 3131. In this example, the shaft 316 and the rollers 312, 313 are made of steel. To provide the sliding bearings 3121, 3131, the shaft 316 is provided with a friction reducing layer, in this example a PVD (physical vapour deposition) coating. By this arrangement, the rollers 312, 313 are adapted to turn independently of one another. It should be noted that alternatives are possible. For example, the rollers could be made in any suitable alternative to steel, e.g. a ceramic material. Further, the bearings could be in any suitable alternative form, for example provided by bearing bushings, e.g. in bronze.

It should be noted that in this example the rollers 312, 313 are identical, meaning that they have the same extension in the axial direction and radial direction. In other embodiments however, the rollers could be dissimilar. For example, they could present different axial extensions, which could be beneficial where the loadings on the rollers are different, and there is a lack of space around the rollers. In some embodiments, the rollers could have different radial extension, to be adapted to cams with mutually different radial extensions.

Herein, the axial direction, referred to in relation to the rollers, is parallel to the rotational axis of the rollers.

Each roller presents a heel 3122, 3132 at each end of its axial extension. Each heel 3122, 3132 is provided as an axial protrusion around a centre shaft hole of the respective roller, with a flat surface 3123, 3133 oriented in a plane with a normal which is parallel to the axial direction. Said flat heel surfaces 3123, 3133 provide sufficient areas of the respective roller 312, 313 for a reduced wear in any axial contact with the other roller 312, 313 and the respective support arm 314, 315. The flat heel surfaces 3123, 3133 are however kept to a moderate size to keep the friction torque between the rollers 312, 313, and between the rollers and the support arms 314, 315, relatively low; this will facilitate mutually different speeds between the rollers, and reduce the risk of skidding, as described further below.

Figure 7:
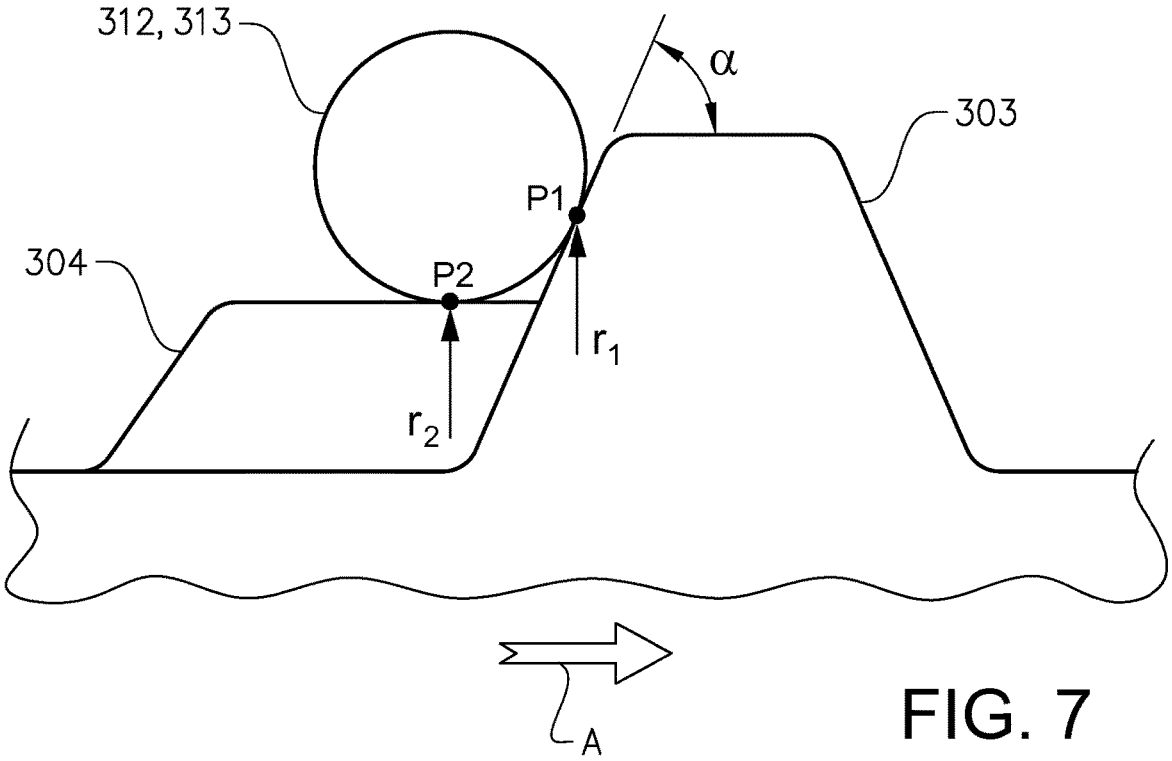
FIG. 7 shows schematically a transit of rollers from one cam to another cam, where a rotational movement is depicted as a straight movement.

Reference is made to FIG. 7. The cam follower 311 comprising two rollers 312, 313, each roller 312, 313 being adapted to follow a respective of the cams 303, 304, avoids the risk of skidding of the cam follower in relation to the cams 303, 304. More specifically, when the cam follower 311 transits from one of the cams to the other one, due to local differences in the inclination or declination of the cams 303, 304, the rotational speeds to which the cams 303, 304 urges rollers 312, 313 will be different. Two rollers will allow individual adaption of the rotational speed to the respective cam.

In this example, the first cam 303 provides a high initial valve lift. The second cam 304 with a lower profile can be turned so as to be largely in the same circumferential position as the higher. By turning the camshaft in relation to each other, the second cam 304 can be made to follow the first cam 303. In this example, such an extended combined cam profile makes it possible to run the engine in an Atkinson cycle at suitable engine operating points. An Atkinson cycle is here referred to as, as is known per se, a modified Otto or Diesel cycle in which the intake valve is held open longer than normal to allow a reverse flow of intake air into the intake manifold, providing a higher efficiency in exchange for a reduced power density.

FIG. 7 depicts schematically a transit of the rollers 312, 313 from the first cam 303 with the higher profile to the second cam 304 with the lower profile. The rotational movement (A in FIG. 3) of the camshafts 301, 302 is for simplicity depicted in FIG. 7 as a straight movement indicated by the arrow A. Also, the shape of the cam profiles 303, 304 is simplified compared to what might be used in practice. In the transit, one of the rollers 312 is in contact with the first cam 303 at a point P1, and the other of the rollers 304 is in contact with the second cam 304 at a point P2.

The instantaneous speed imposed to a contact surface on one of the rollers 312 by the first cam 303 is $r1*\omega/\cos\alpha$, where r1 is the radial position of P1 in relation to the camshaft rotational axis, $\omega$ is the camshaft rotational speed, and $\alpha$ is the declination of the first cam 303 at P1. The instantaneous speed imposed to a contact surface on the other roller 313 by the second cam 304 is $r2*w$, where r2 is the radial position of P2 in relation to the camshaft rotational axis. The speed at P2 is not affected by any local inclination or declination of the cam 304.

It is understood that the instantaneous speeds imposed by the cams to the roller contact surfaces are at the moment depicted in FIG. 7 dissimilar. Therefore, a single roller of the cam follower would have caused skidding of the roller surface against one or both of the cams. This in turn might cause excessive wear. The provision of two rollers 312, 313, each roller being adapted to follow a respective of the cams 303, 304, allows individual adaption of the rotational speed to the respective cam. Thereby the skidding problem and the risk of excessive wear is eliminated.

Reference is made to FIG. 5. Each of the rollers 312, 313 presents a contact surface 312*a*, 313*a* having a smaller extension in an axial direction than its associated cam 303, 304. The mounting of the rollers 312, 313 on the shaft 316 as described above, allows for a relatively small axial freedom of movement of the respective roller 312, 313. In particular this axial freedom of movement is shorter than the difference between the axial extensions of the contact surface 312*a*, 313*a* and the associated cam 303, 304. Thereby, possible axial movements of the roller may be kept within the axial extension of the cam, which in turn eliminates any risk of contact of the roller with one of the cam edges. This in turn reduces the risk of excessive wear. The allowed axial movement of each roller might be 1.0-10.0%, preferably 1.7-5.0%, of the axial extension (width) of the roller.

Figure 8:
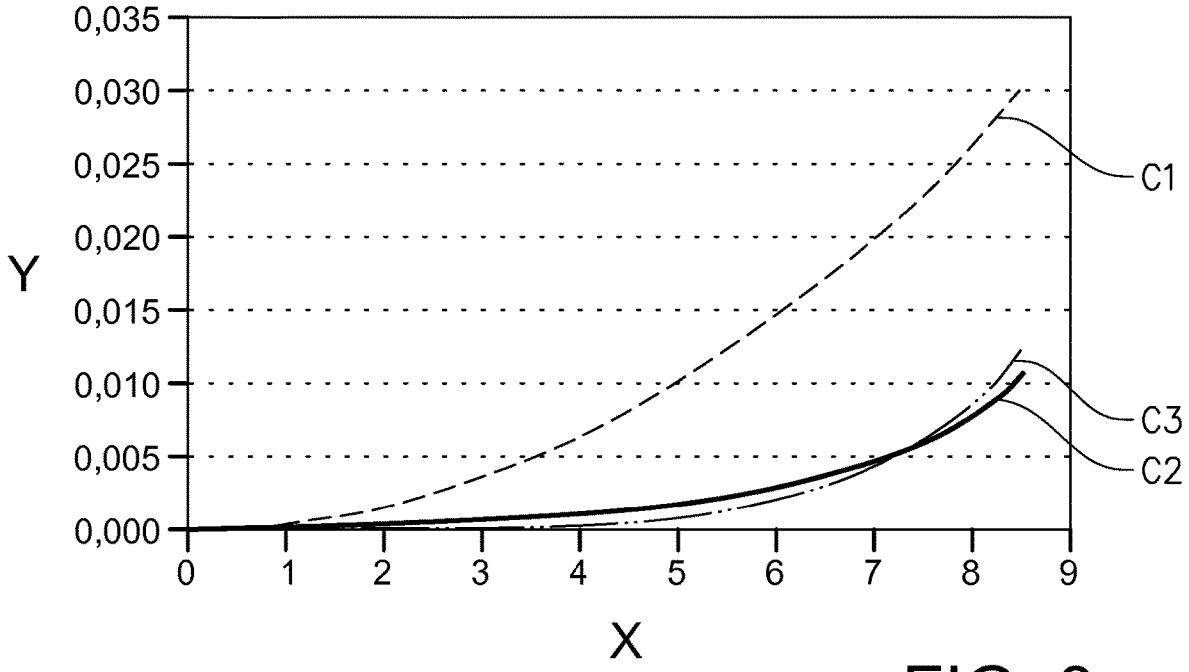
FIG. 8 is a graph showing examples of crowning profiles of a roller of the variable valve actuation mechanism in FIG. 2.

Reference is made also to FIG. 4, FIG. 6 and FIG. 8. Each contact surface 312*a*, 313*a* has a crowning profile. This will reduce the risk of edge contacts between the rollers and the cam, with high stress concentrations as a result. The crowning means that the radial position of the contact surface 312*a*, 313*a* varies in the axial direction of the roller, so that it presents a convex shape. As can be seen in FIG. 8, the contact surface has its greatest radial extension at its mid-point as seen in the axial direction; this mid-point is at zero on the x-scale in the graph. The x-scale shows axial positions in mm. The y-scale indicates in mm the deviation of the radial position of the contact surface 312*a*, 313*a* from the maximum radial extension.

The crowning will effectively remove edge material from the rollers 312. 313. Any suitable crowning shape can be provided. The graph in FIG. 8 shows three examples of crowning as presented in US2010138020A1: a part-circular crowning C1, a crowning shape of a logarithmic function C2, and a crowning shape C3 of a function in the form of Y(X)=AX^B where A and B are real numbers and B is greater than 2. The crowning may suitably provide, in the axial direction of the roller, a variation of 0.005-0.050 mm, preferably 0.010-0.030 mm, of the radial position of the contact surface 312*a*, 313*a*.

As stated the provision of two rollers 312, 313, each following their respective cam 303, 304, reduces the risk for edge contact between cams and rollers. The crowning increases acceptable tolerances to misalignment in a manufacturing process or misalignment due to operating loads, and thereby it further reduces this risk for edge contact between cams 303, 304 and rollers 312, 313. In addition, each contact surface 312*a*, 313*a* having a smaller extension in an axial direction than its associated cam 303, 304, makes it possible to secure that an angular misalignment between the rollers 312, 313 and the cams 303, 304 does not lead to any contact between a cam edge and a roller. If the rollers are crowned in a proper way, contacts between the cams and the rollers, without any edge contact, will be secured. The provision of two rollers each having crowned contact surfaces, which are less wide than the respective cams, thus provides a solution which is robust in the avoidance of sharp edge contacts, thereby reducing or eliminating the risk for excessive wear.

Figure 9:
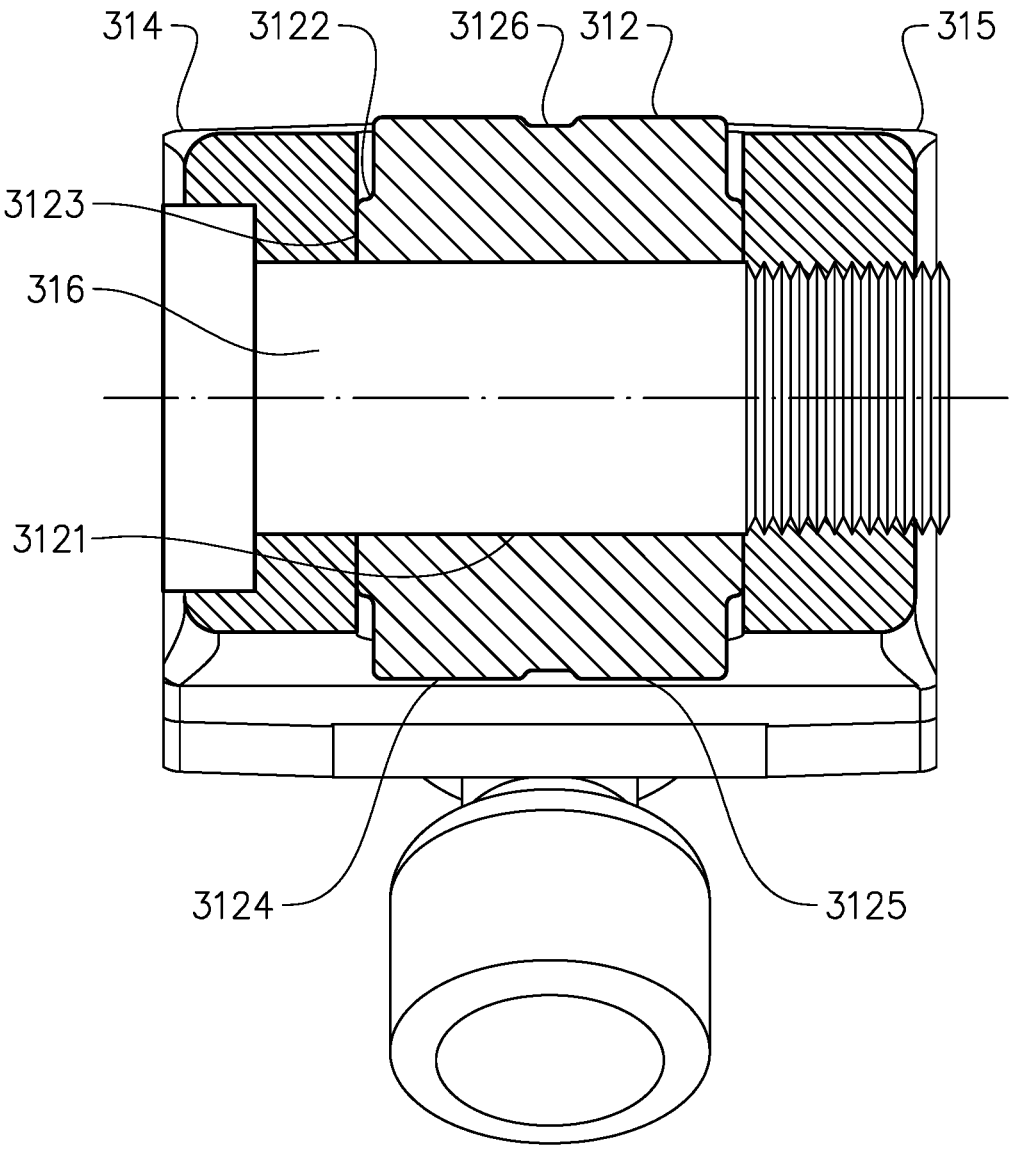
FIG. 9 shows a cross-sectional view of a variable valve actuation mechanism according to an alternative embodiment, with the section oriented as indicated with the arrows VI-VI in FIG. 3.

FIG. 9 depicts a part of a variable valve actuation mechanism according to an alternative embodiment. In this embodiment, the cam follower 311 includes a single roller 312. The roller 312 is mounted between the two support arms 314, 315. The roller presents, as seen in the cross-section in FIG. 9, two protuberances 3124, 3125 being adapted to follow a respective of the cams 303, 304. The protuberances 3124, 3125 each present a crowned contour. The protuberances 3124, 3125 are separated by a concavity 3126. It should be noted that the variations of the radial positions of the protuberances 3124, 3125 and the cavity 3126 are exaggerated in FIG. 9 to enhance the visualization of them. The variations of the radial positions of the protuberances 3124, 3125 are preferably in the same order of magnitude as those provided by the roller crowning described above.

The protuberances 3124, 3125 and the cavity 3126 provides for avoiding any contact between the roller 312 and the cam edges, as well as roller edge contact with any of the cams.

Above embodiments of the invention have been described as valve actuation mechanisms for intake valves. It should be noted that the invention is equally applicable to valve actuation mechanisms for exhaust valves.

The invention claimed is:

1. A variable valve actuation mechanism for an internal combustion engine comprising at least one valve for control of gas admission to a cylinder of the engine and/or gas exhaust from the cylinder, comprising:

two camshafts, wherein the two camshafts are concentrically arranged;

a cam set comprising two cams, each of the two cams fixed to a respective one of the two camshafts, whereby the two camshafts are arranged to be turned in relation to each other, so as to change a combined profile of the cams; and a cam follower adapted to follow the combined profile of the two cams and to actuate a valve in dependence on the combined profile of the two cams, wherein the cam follower comprises two rollers, each of the two rollers being adapted to follow a respective one of the two cams.

2. A variable valve actuation mechanism according to claim 1, wherein at least one of the two rollers presents a contact surface having a crowning profile.

3. A variable valve actuation mechanism according to claim 2, wherein the crowning profile provides, in an axial direction of the roller, a variation of 0.005-0.050 mm, preferably 0.010-0.030 mm, of a radial position of the contact surface.

4. A variable valve actuation mechanism according to claim 1, wherein least one of the two rollers presents a contact surface having a crowning profile with a crowning shape of a logarithmic function.

5. A variable valve actuation mechanism according to claim 1, wherein at least one of the two rollers presents a contact surface having a crowning profile with a crowning shape of a function in the form of Y(X)=AX B where A and B are real numbers and B is greater than 2.

6. A variable valve actuation mechanism according to claim 1, at least one of the two rollers presents a contact surface having a crowning profile providing a part-circular outer surface for contacting the respective one of the two cams.

7. A variable valve actuation mechanism according to claim 1, wherein at least one of the two rollers presents a contact surface having a smaller extension in an axial direction than the respective one of the two cams.

8. A variable valve actuation mechanism according to claim 7, wherein an axial freedom of movement of at least one of the two rollers is shorter than a difference between the axial extensions of the contact surface of the at least one of the two rollers and the respective one of the two cams.

9. A variable valve actuation mechanism according to claim 1, wherein the two rollers are fixed concentrically in relation to each other.

10. A variable valve actuation mechanism according to claim 1, wherein the cam follower comprises two support arms and wherein the two rollers are mounted between the two support arms.

11. A variable valve actuation mechanism according to claim 10, wherein the cam follower comprises a shaft, which is supported at each end in one of the two support arms and wherein the two rollers are concentrically arranged on the shaft.

12. A variable valve actuation mechanism according to claim 1, wherein the cam follower comprises a shaft, the two rollers being concentrically arranged on the shaft via respective sliding bearings.

13. A variable valve actuation mechanism according to claim 12, wherein the shaft is provided with a friction reducing layer.

14. A variable valve actuation mechanism according to claim 1, wherein a shaft is made of steel.

15. A variable valve actuation mechanism according to claim 1, wherein the two rollers are made of steel.

16. A variable valve actuation mechanism according to claim 1, wherein each roller presents a heel at each end of an axial extension.

17. A variable valve actuation mechanism according to claim 16, wherein each heel is provided as an axial protrusion presenting a flat surface oriented in a plane with a normal which is parallel to an axial direction of the respective of the two rollers.

18. A variable valve actuation mechanism according to claim 1, wherein the two rollers are adapted to turn independently of one another.

19. A variable valve actuation mechanism according to claim 1, wherein the two rollers have a substantially same extension in an axial direction and/or radial direction.

20. A variable valve actuation mechanism according to claim 1, wherein the two rollers have different extensions in an axial direction.

21. A variable valve actuation mechanism according to claim 1, wherein the two cams are arranged to be moved in relation to each other by turning of one of the two camshafts so as to change the combined profile of the two cams.

22. An internal combustion engine comprising a variable valve actuation mechanism according to claim 1.

23. A vehicle comprising an engine according to claim 22.

24. A variable valve actuation mechanism for an internal combustion engine comprising at least one valve for control of gas admission to a cylinder of the engine and/or gas exhaust from the cylinder, comprising:

two camshafts that are concentrically arranged, a cam set comprising two cams, each of the two cams fixed to a respective one of the two camshafts, whereby the two camshafts are arranged to be turned in relation to each other, so as to change a combined profile of the two cams, and a cam follower adapted to follow the combined profile of the two cams and to actuate a valve in dependence on the combined profile of the two cams, wherein the cam follower comprises a roller presenting, in a cross-section coinciding with a rotational axis of the roller, two protuberances being adapted to follow a respective one of the two cams, the two protuberances being separated by a concavity.

* * * * *